US007500650B2

(12) United States Patent
Deplazes et al.

(10) Patent No.: US 7,500,650 B2
(45) Date of Patent: Mar. 10, 2009

(54) SAFETY CIRCUIT FOR LIFT DOORS

(75) Inventors: Romeo Deplazes, Oberrüti (CH); Philipp Angst, Zug (CH)

(73) Assignee: Inventio AG, Hergiswil (CH)

( * ) Notice: Subject to any disclaimer, the term of this patent is extended or adjusted under 35 U.S.C. 154(b) by 215 days.

(21) Appl. No.: 10/802,567

(22) Filed: Mar. 17, 2004

(65) Prior Publication Data

US 2004/0173410 A1 Sep. 9, 2004

Related U.S. Application Data

(63) Continuation of application No. PCT/CH02/00498, filed on Sep. 11, 2002.

(30) Foreign Application Priority Data

Sep. 18, 2001 (EP) ..... 01810803

(51) Int. Cl.
*B66D 1/50* (2006.01)

(52) U.S. Cl. ..... 254/275; 187/248; 187/277; 187/393

(58) Field of Classification Search ..... 254/275; 187/288, 248, 277, 371, 391, 393, 316
See application file for complete search history.

(56) References Cited

U.S. PATENT DOCUMENTS

| | | | | |
|---|---|---|---|---|
| 4,106,593 | A * | 8/1978 | Otto et al. | 187/393 |
| 4,512,442 | A * | 4/1985 | Moore et al. | 187/393 |
| 5,780,788 | A * | 7/1998 | Eschenbrenner et al. | 187/316 |
| 6,173,814 | B1 | 1/2001 | Herkel et al. | |
| 6,357,553 | B1 * | 3/2002 | Vialonga | 187/385 |
| 6,427,807 | B1 * | 8/2002 | Henneau | 187/247 |
| 6,516,923 | B2 * | 2/2003 | Lence Barreiro et al. | 187/391 |
| 6,591,947 | B2 * | 7/2003 | Horbrugger et al. | 187/393 |
| 6,988,594 | B2 * | 1/2006 | Deplazes et al. | 187/393 |
| 2007/0016332 | A1 * | 1/2007 | Tyni et al. | 700/275 |

* cited by examiner

*Primary Examiner*—Emmanuel M Marcelo
(74) *Attorney, Agent, or Firm*—Schweitzer Cornman Gross & Bondell LLP

(57) ABSTRACT

An improved lift system door control or safety circuit utilizes locking devices for the lift shaft doors and lock sensors to monitor the status of the locking devices. The lock sensors are coupled to a lift drive unit control through a data bus, which need not be especially designed as a safety data bus. The lock sensors are repeatedly interrogated at short term intervals. The status of the doors is interrogated on a longer time interval, and such data is also passed to the drive unit control by the data bus. The interrogations are used to determine the operating condition of the locking sensors as well as whether communications or transmission errors are present.

16 Claims, 1 Drawing Sheet

SAFETY CIRCUIT FOR LIFT DOORS

The subject of the invention is a control or safety circuit for lift doors of a lift system. The present application is a continuation of PCT/CH02/00498, filed Sep. 11, 2002.

BACKGROUND OF THE INVENTION

Lift systems currently have so-termed double doors, i.e. not only shaft doors, but also cage doors arranged at the lift cage. The opening and closing of the shaft doors is usually induced by the cage or the cage doors. For the safety of the users of the lift systems and the visitors in the buildings incorporating the lift systems it is of great importance for the respective setting of the shaft and cage doors to be coordinated with the position of the lift cage, i.e. the shaft and cage doors may open only when the lift cage stops at one of the provided boarding and disembarking stations, i.e. at the level of a story. For this purpose, the positions not only of the shaft doors, but also of the cage doors are monitored.

The shaft doors can usually be locked in their closed setting with the help of mechanical locking devices. Conventional monitoring systems monitor the setting of the shaft doors with the assistance of safety contacts; these safety contacts detect whether the mechanical locking devices adopt their locking setting or their unlocking setting. The safety contacts are closed when the locking devices are disposed in their locking setting and the shaft doors are closed. The safety contacts are integrated in a safety circuit, which in turn is closed only when safety contacts are closed. The safety circuit is so connected with the drive of the lift system that the lift cage in normal operation can be moved upwards or downwards only when the safety circuit is closed. If a shaft door is open and its locking device is in the unlocking setting, then the corresponding safety contact and thus the safety circuit are open, which has the consequence that the lift cage cannot perform any upward or downward movement except with the help of a special control or if service personnel bridge over the interrupted safety circuit.

Every lift system with such a conventional monitoring means has various disadvantages which are described in more detail in the following.

- A safety circuit is in every case subject to inherent problems; including the length of the connections, the voltage drop in the safety circuit and the comparatively high assembly cost.
- Despite the presence of a monitoring system with a safety circuit, unsafe or risky situations cannot be avoided. On the one hand, the safety contacts can be readily easily bridged over individually or in common, which is virtually equivalent to absence of the safety precautions. On the other hand, an open shaft door may indeed prevent movement of the cage, but if the cage is not disposed at the open shaft door the risk accordingly exists of falling through the open shaft door.
- Intelligent or situation-appropriate reactions, for example when the safety circuit is open, are not possible, since the cage in every case is stationary; in particular, it cannot be avoided that persons are unintentionally trapped in the lift cage.
- The monitoring system does not allow a specific diagnosis, i.e. when the safety circuit is open it can only be established that at least one safety contact and thus at least one locking device or at least one shaft door is open. However, it cannot be established which safety contact or contacts is or are open.
- Precautionary maintenance is not possible, since there are no indications about the state of the safety contacts; it is thus not possible to service the lift system in advance and replace worn safety contacts in good time, but still at a point in time in which the lift system can be shut down without problems, except within the scope of a periodic inspection, wherein, however, in many cases taking the lift system out of operation—which is not necessary per se—is carried out. The availability of the lift is restricted, since an open safety contact always has the consequence of taking the lift system out of operation, even when another solution, for example not travelling in the affected shaft section, would be possible.

A functionally improved solution can be achieved if a data bus is used for detection or transfer of the data which concerns safety, in conjunction with the setting of the shaft doors. Since, however, the corresponding data are safety-relevant, a safety bus has to be used. Such a safety bus and, in particular, the safety bus nodes required for that purpose are, however, comparatively expensive and therefore hardly come into consideration for standardized lift systems.

The object of the invention is thus to create an improved lift system of the kind stated in the introduction that with respect to safety precautions in conjunction with the setting of the shaft doors on the one hand avoids the disadvantages of the state of the art and on the other hand is comparatively economical.

BRIEF DESCRIPTIONS OF THE INVENTION

According to the invention the foregoing and other objects are fulfilled by a lift system having a data bus connected to a drive unit control which is connected to door-locking devices and sensors by way of the data bus Means are provided for repeatedly automatically interrogating the lock sensors at short time intervals through the data bus. Communication interrupters and transmission errors can be quickly detected and updated. The state of the locking sensor can also be monitored.

The lift system according to the invention comprises a monitoring system with a standard data bus. The data concerning the setting of the shaft doors are detected or transferred by way of this data bus. Instead of a safety data bus there is used a conventional data bus with usual standard bus nodes; in that case, the data bus can be that which is present in any case for the transfer of process data in the lift shaft. The use of a comparatively expensive safety data bus, including the costly safety bus nodes which are required for that purpose and which would be required due to the safety relevance of the data to be transferred is avoided; suitable measures are undertaken in order to ensure transmission security of safety-relevant data by way of the data bus which is non-safe per se.

For ascertaining the state or the setting of the shaft door or the locking device thereof a locking sensor is associated with each shaft door or each locking device. The locking sensor is connected with the conventional data bus which transfers the ascertained data to the control unit or monitoring unit. The control unit or monitoring unit then evaluates the acquired data. This takes place through the periodic interrogation, for example at intervals of 20 milliseconds, of the locking sensors. Thus, a communications interruption in the region of the data bus or the bus nodes can be detected very quickly. Moreover, each locking sensor, inclusive of the associated interface, may be tested periodically or at longer intervals in time, for example once within each 8 or 24 hours. For that purpose the corresponding shaft doors are opened and closed again or the contacts actuated (unlocked/locked), and it is observed whether in that case the correct data are transferred to the control unit or monitoring unit. This test can be carried out during normal operation on opening and closing of the shaft doors. If a story is not travelled to within the predetermined time period of 8 or 24 hours, then for test purposes a test travel to this story can be initiated by the control unit (an obligatory test). The execution of all tests is monitored in the control unit and preferably recorded in a table.

For storeys which are seldom travelled to, the locking sensor and the corresponding interface are preferably designed to be safety-oriented. This is recommended particularly for storys to which the lift cage may not be automatically controlled, for example because a dwelling unit, such as for example a penthouse, can be entered directly from the lift shaft.

The expression "safety-oriented" is used in the following for control means, actuators, etc., which are relevant for ensuring the safety of persons and accordingly are executed as components with increased functional reliability. Such "safety-oriented" components are distinguished by, for example, redundant data detection, data transmission and data processing and/or by software plausibility checking of the data, which is detected, transmitted and processed by it, and/or by actuators present in redundant form.

If necessary for reasons of safety, further means additional to the locking sensors can be provided for detecting the state, particularly the setting, of the shaft doors; such means transfer data about the setting or the state of the shaft door to the control, either by way of the data bus which is present in any case or, in a further safety-oriented embodiment, through an additional safety bus inclusive of safety nodes.

The shaft doors are preferably constructed to be self-shutting, i.e. they close automatically as soon as they are not actively held open. In addition, the locking means are self-shutting when the shaft door is closed. Active locking is not necessary.

For reasons of safety the locking devices used for locking the shaft doors are preferably so constructed that they can be unlocked, opened or closed only by a cage door provided at the lift cage or that they can be unlocked by a special tool and slid open by hand.

The state of the shaft door and the locking device thereof may be advantageously monitored by way of the locking sensor arranged at the shaft door.

Locking device contacts, microswitches, inductive sensors, capacitive sensors or optical sensors are examples of locking sensors that can be used.

The control of the lift system is preferably so constructed that it evaluates the interrogation of the locking sensors in order to trigger one or more predefined reactions, particularly the recognition and localization of a fault, the triggering of a service call, the stopping of a lift cage or the carrying out of another situation-adapted reaction in the case of recognition of a shaft door staying open.

The control can also be so constructed that it evaluates the interrogation of the locking sensors in order to correct ascertained transmission errors by the evaluation of several data packets.

It is particularly advantageous with respect to safety of the lift system if, in addition to the monitoring of the shaft doors, the cage door is also monitored; as a consequence, by means of coincidence checking of the signals of the shaft doors on the one hand and the cage door on the other hand a determination of the functional capability of the shaft doors and/or the locking sensors of the shaft doors can be obtained.

The significant advantages of the arrangement according to the invention are the following:

The safety circuit of the conventional monitoring system is superfluous; the corresponding inherent disadvantages are thereby avoided; in addition, if an already present data bus is used, the wiring or assembly cost is small.

The safety of the lift system is increased by comparison with a lift system with a safety circuit in the safety system. Bridging-over of contacts is indeed possible by software, but it can be recognized and can be cancelled after a predefined time. Safety is maintained even if, for example, a fault arises or a service is undertaken.

The monitoring system allows specific diagnoses, because a fault can be immediately localized and remotely transmitted.

Servicing in advance is possible, because the state of the sensors, particularly of the locking sensors, can be analysed.

The availability of the lift is increased.

The safety of the lift system can additionally be increased by the following measures: The monitoring of the cage door can be realized in safety-oriented manner, whereby the meaningfulness of the coincidence check is enhanced. For that purpose the sensor associated with the cage door must, as also the connected data bus and the bus nodes, be constructed in safety-oriented manner.

BRIEF DESCRIPTION OF THE DRAWING

The invention is described in the following on the basis of an example of embodiment and with reference to the drawing, in which.

DETAILED DESCRIPTION OF THE INVENTION

Figure 1:
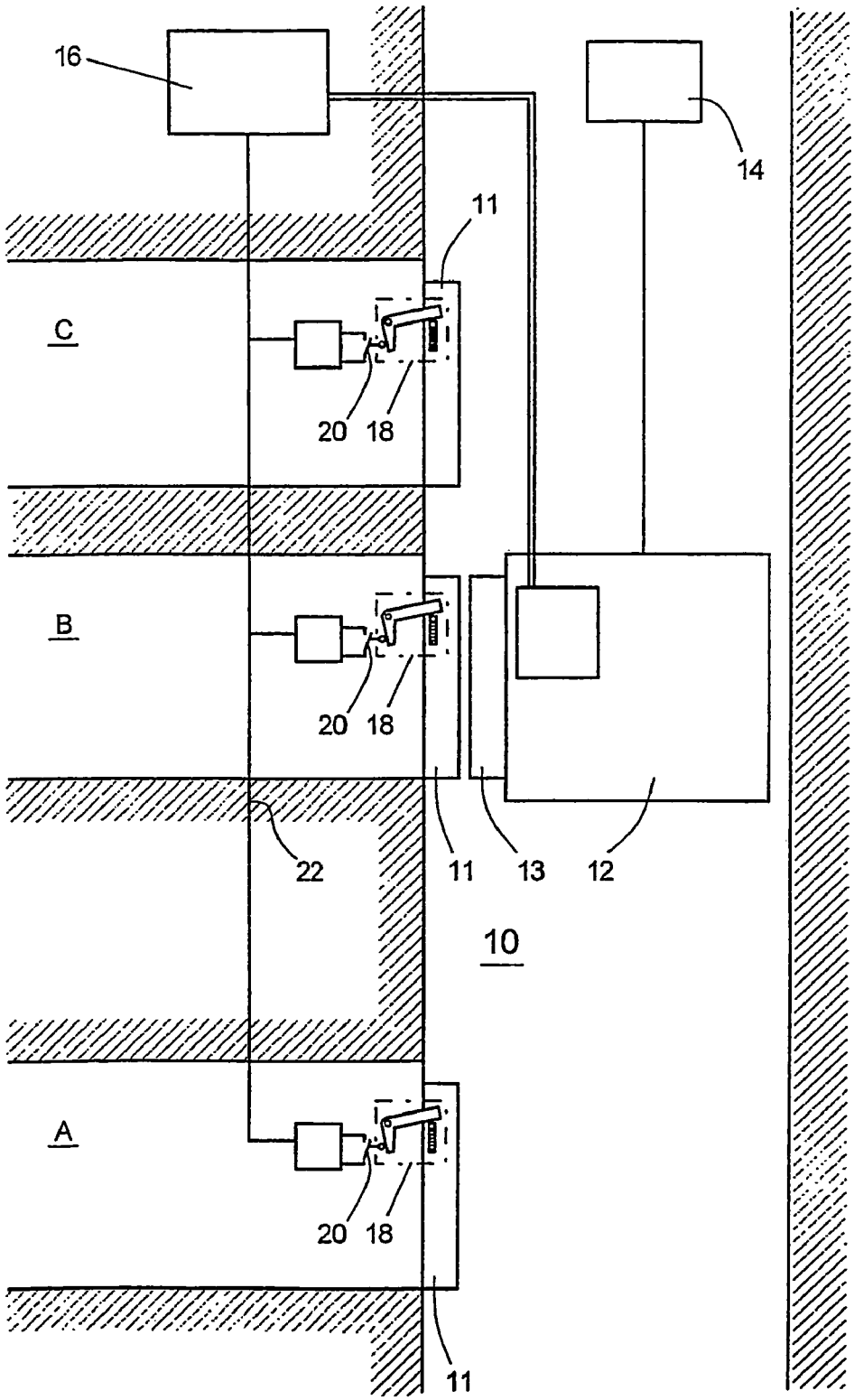
FIG. 1 is a greatly simplified schematic illustration of a lift system with a monitoring system according to the invention.

The lift system 10 illustrated in FIG. 1 is intended for serving three storys A, B and C. A shaft door 11 is present in each of the storys A, B, C. The shaft door 11 serves the purpose of separating a lift shaft, in which a lift cage with a cage door 13 can move upwardly and downwardly, from the surrounding space. The movement of the lift cage 12 is carried out with the help of a drive unit 14 and is controlled by a control 16. In principle, the shaft door should be open only when the lift cage 12 is located at the corresponding story. The shaft door is controlled for this purpose by the cage door 13 of the lift cage 12, wherein it is locked in its closed setting by a locking device, which in the following, is termed a "locking device" 18. For establishing the state, in particular the setting, of the locking device 18 and thus the shaft door, a contact device with a locking device contact is provided as locking sensor 20. The contact device with the locking device contact is connected with the control 16 by way of a data bus 22. In addition, the lift cage 12 is connected with the control 16 in terms of controlling.

The above-described lift installation 10 functions as follows:

A locking sensor 20 or locking device contact 20 associated with each locking device 18 or each shaft door makes available data or information concerning the state of the locking device 18 or the shaft door. The data bus 22 transmits the data or information to the control 16, which periodically evaluates the received data or information. The control 16 interrogates the locking sensors 20 at short intervals in time of, for example, 20 milliseconds so that a communications interruption in the region of the data bus 22 or the bus nodes can be detected very rapidly.

In addition to the above-described constantly performed test, a further test takes place at longer intervals in time. If the lift cage 12 has concluded travel to one of the storys A, B or C, then the cage door opens. The shaft door 11 of the story which has been driven to is, in the normal case, unlocked by the cage door 13 and opened. In that case the further test is carried out, for example, once in a time period of 8 to 24 hours. The locking contact 20 is tested. If it is found to be in order, then a corresponding entry is made in a table, whereby the state 'contact in order' and the point in time of the test are stored. Performance of the test can be checked by the entry in the table.

If the shaft door 11 indeed opens, but exhibits on opening an unplanned behavior, then this in itself indicates a slight fault, for example with respect to wear or contamination in the region of the doors and/or the locking device 18. In this case the lift system 10 can remain in operation at least temporarily, but a notification or recommendation to provide a very prompt check and inspection by service personnel can be provided.

If the locking contact 20 does not open it has to be inferred therefrom that the contact is detective, but the lock was released and the shaft door opened. The lift cage 12 in this case must no longer remain in operation; the lift system 10 must be taken out of operation and it is essential to call in service personnel, as in this case an unintended opening of the shaft door concerned can no longer be recognized.

Before departure from the story the shaft door and the locking device 18 are in principle closed by the cage door 13 and the lock shuts. In that case, whether the locking contact 20 at the shaft side indicates that the shaft door 11 is closed, is checked. At the same time the closed state of the cage door 13 is monitored in a safety-oriented manner, whereby a coincidence check of the two closing processes is possible and thus safety is increased. If the result of these two examinations is positive, the lift cage 12 can be set in motion.

If at least one of the mentioned checks has a negative result, a recovery attempt can be performed. For this purpose, a multiple closing and opening of the doors is carried out. If the recovery attempt has the consequence that the shaft door 11 is closed and locked, then the lift system 10 can indeed remain in operation, but a service should be kept in mind, at least when repeated recovery attempts have to be carried out.

If, after performance of the recovery attempt, the shaft door 11 is still open, then the lift system must go out of operation and service personnel must be called.

If a shaft door is open without the lift cage 12 having been driven to the corresponding story, then it has to be concluded therefrom that the shaft door was opened from the outside; this can happen either by an authorized person with a special tool or in an unauthorized manner by the exercise of force, since it is impossible to open the shaft doors unintentionally or through faulty operation. The staying open of the shaft door 11 is recognized only by way of the non-safety-oriented data bus. The non-safety-oriented detection of this state of the shaft door 11 can, however, be considered as sufficient for the following reasons: Firstly, this case arises only extremely rarely. Secondly, authorized persons are instructed as a matter of profession with respect to potential risks and are obliged to switch the lift system into the service mode before they open a shaft door. Thirdly, the locking contacts are regularly checked, for example every 8 hours. Fourthly, the state of the locking contacts is interrogated by the control 16 at a certain frequency, so that transmission errors are filtered out and can thus be tolerated. Fifthly, the shaft doors are constructed to be self-shutting.

If opening of the shaft door 11 does not take place from the lift cage 12, then the lift system immediately switches out of the normal operating mode and also does not return to the same without it having been ensured that the shaft door 11 is actually closed. The lift system therefore cannot be placed in operation by bridging over the locking contacts.

The essential advantages of the new lift system are the following:

For monitoring there is no requirement at the individual storys for a safety-oriented bus connection, but only a conventional, non-safety-oriented bus connection. Conventional, non-safety-oriented bus connections are in any case mounted at each story in order to detect calls and to control the indications. The omission of numerous safety-oriented bus connections leads to a considerable reduction in installation costs.

Each locking contact is individually read and checked. It is not only established that a fault or an error has arisen, but the fault or the error can be precisely localized, whereby in the case of disturbance an accelerated diagnosis can be undertaken.

Not only faults and errors, particularly failure of locking sensors or locking contacts, can be discerned, but also the respective state of the locking sensors or locking contacts, particularly with respect to bounce behavior and voltage drop, can be detected before a disturbance occurs.

On the basis of such information a precautionary servicing of the locking contacts can be undertaken. In most cases faults and errors arising due to failing locking contacts can be avoided.

Unnoticed bridging over the locking contacts is not possible, since the control would recognize a signal change taking place at an unintended point in time. The safety of the shaft door monitoring is thereby additionally increased.

On occurrence of a disturbance the fact that open locking contacts can be localized allows the lift cage to travel to the next possible story without having to go past the affected shaft door with the open contact; the passengers can thus disembark in every case and do not remain trapped for a longer period of time. Subsequently thereto, different reactions can be carried out; the lift cage can remain at that story at which the passengers have disembarked, and the service personnel called up, or the lift cage is—if it is disposed below the story with the defective locking contact—moved to a position in which its cage roof is disposed slightly below the opened shaft door so that the risk of a person falling through the opened shaft door in the lift shaft is eliminated, or the lift cage is moved at low speed and preferably accompanied by an acoustic signal to the affected story with the opened shaft door. A recovery attempt can be carried out and if this is successful the lift system is again operationally ready.

We claim:

1. A control circuit for a lift system having a lift cage movable in a lift shaft by a drive unit, a control for controlling the drive unit, a data bus connected with the control, shaft doors for closing the lift shaft, locking devices for locking the shaft doors at a shaft side and locking sensors for monitoring the setting of the locking devices, wherein the locking sensors are connected with the control by way of the data bus, the control circuit comprising means for repeatedly interrogating a locking sensor at short time intervals by way of the data bus whereby communications interruptions or transmission errors in data bus transmissions are detected, and for periodically testing the function of the locking sensors of all lift shaft doors by a) observing the signals locking sensors produce during opening/closing of the shaft doors in normal lift operation and b) automatically initiating a test travel of the lift cage to a story whose shaft door has not been operated within a defined period of time, opening and closing the shaft door, and observing the signals produced by the locking sensor associated with the shaft door.

2. The control circuit according to claim 1, characterized in that the locking device is self-shutting when the corresponding shaft door is closed.

3. The control circuit according to claim 2, characterized in that the locking devices for locking the shaft doors are of a construction whereby they can be unlocked, opened or closed only by a cage door provided at the lift cage and can be unlocked by a special tool and slid open by hand.

4. The control circuit according to claim 2, wherein the locking sensor includes means for monitoring the state of the associated locking device and shaft door.

5. The control circuit according to claim 4 wherein the locking sensor is chosen from a group consisting of a locking device contact, a microswitch, an inductive sensor, a capacitive sensor and an optical sensor.

6. The control circuit according claim 1 or 2, characterized in that the control includes means for evaluating interrogation of the locking sensors in order to be able to trigger one or more of the following operations: recognition and localization of a fault; triggering of a service call; or, if an open shaft door was recognized, stopping lift cage or carrying out a situation-adapted reaction.

7. The control system according to claim 6, further including means for initiating a recovery attempt in the event of receipt of a negative result of one of the operations, including means for performing a multiple closing and opening of the shaft door to achieve a correctly closed and locked shaft door.

8. The control system according to claim 6, further including means for carrying out a situation-adapted reaction comprising means to allow the lift cage to travel to a next story reachable without requiring the cage to pass the shaft door with an open contact.

9. The control system according to claim 6, further including means for carrying out a situation-adapted reaction comprising means to allow the lift cage to be moved to a position I which its cage roof is disposed slightly below the shaft door having a door locking problem whereby the risk of a person falling through an open shaft door in the lift shaft is minimized.

10. The control system according to claim 6, further including means for carrying out a situation-adapted reaction comprising means to move the lift cage at a slow speed to an affected story showing a door locking problem and conducting multiple door openings and closings allow the lift cage to be moved to a position in an attempt to clear the problem and return the lift cage to an operational ready state.

11. The control system according to claim 1 or 2, characterized in that the control includes means for evaluating the interrogation of the locking sensors in order to correct ascertained transmission errors by evaluation of several data packets.

12. The control system according to claim 11, further including means for monitoring a cage door by enabling a coincidence check of the signals of a shaft door and the cage door, to evaluate the functional capability of at least one of the shaft door and the locking sensor of the shaft door.

13. The control system according to claim 12, characterized in that the monitoring of the cage door is carried out by a safety bus in order to increase safety.

14. The control system according to claim 12, further including means for initiating a recovery attempt in the event of receipt of a negative result of a coincidence check, including means for performing a multiple closing and opening of the shaft door to achieve a correctly closed and locked shaft door.

15. The control system of claim 1 or 2 wherein the defined period of time is between 8 and 24 hours.

16. The control system according to claim 1, further including in addition to the locking sensors further means for detecting a state of the shaft doors and for transmitting information about the state of the shaft door by way at least one of the data bus or a safety bus to the control.

* * * * *